US007887047B2

(12) United States Patent
Bakker et al.

(10) Patent No.: US 7,887,047 B2
(45) **Date of Patent: *Feb. 15, 2011**

(54) LOW-PROFILE DOCUMENT FEEDING MACHINE WITH HOPPER FLOOR FOR COLUMN FORMING DOCUMENTS

(75) Inventors: Johan P. Bakker, Livingston, MI (US); J. Michael Spall, Commerce, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 1233 days.

This patent is subject to a terminal disclaimer.

(21) Appl. No.: 11/206,729

(22) Filed: Aug. 18, 2005

(65) Prior Publication Data

US 2007/0040318 A1 Feb. 22, 2007

(51) Int. Cl.
*B65H 1/00* (2006.01)

(52) U.S. Cl. ..... 271/161; 271/145; 271/171

(58) Field of Classification Search ..... 271/3.14, 271/4.01, 145, 161, 162
See application file for complete search history.

(56) References Cited

U.S. PATENT DOCUMENTS

| | | | | | |
|---|---|---|---|---|---|
| 3,032,339 | A * | 5/1962 | Misbin et. al. | ..... | 271/149 |
| 3,035,834 | A * | 5/1962 | Bottrell | ..... | 271/34 |
| 4,185,709 | A * | 1/1980 | Irvine | ..... | 177/145 |
| 4,524,965 | A * | 6/1985 | Kulpa | ..... | 271/214 |
| 4,640,505 | A * | 2/1987 | Placke et al. | ..... | 271/209 |
| 5,000,088 | A * | 3/1991 | Cargill | ..... | 101/91 |
| 5,046,713 | A * | 9/1991 | Cargill | ..... | 271/149 |
| 5,244,199 | A * | 9/1993 | Wood | ..... | 271/150 |
| 5,421,570 | A * | 6/1995 | Hube et al. | ..... | 271/145 |
| 6,015,143 | A * | 1/2000 | Jimenez et al. | ..... | 271/4.1 |
| 6,109,604 | A * | 8/2000 | Chu et al. | ..... | 271/10.11 |
| D434,435 | S * | 11/2000 | Brooks et al. | ..... | D18/49 |
| 6,270,070 | B1 * | 8/2001 | Salomon et al. | ..... | 271/111 |
| 6,419,221 | B1 * | 7/2002 | Spall | ..... | 271/31.1 |
| 6,474,637 | B1 * | 11/2002 | Spall et al. | ..... | 271/160 |
| 6,557,850 | B1 * | 5/2003 | Kallin et al. | ..... | 271/274 |
| 7,097,172 | B2 * | 8/2006 | Chang | ..... | 271/171 |
| 7,258,337 | B1 * | 8/2007 | Spall | ..... | 271/149 |
| 2005/0035531 | A1 * | 2/2005 | Sasaki et al. | ..... | 271/126 |

OTHER PUBLICATIONS

Unisys, My Vision X, Aug. 2005.

* cited by examiner

*Primary Examiner*—Stefanos Karmis
*Assistant Examiner*—Howard Sanders
(74) *Attorney, Agent, or Firm*—Honigman Miller Schwartz and Cohn LLP

(57) ABSTRACT

A low-profile document feeding machine includes a feeder, a hopper, at least one processing device, and an output pocket. The feeder feeds documents one at a time from a document stack in the hopper for processing by the at least one processing device and reception by the output pocket. The hopper includes a floor-wall construction for holding the document stack. The floor-wall construction is configured to column-form documents in the document stack. The column-forming provides increased stiffness in the vertical direction and prevents documents from falling/folding over due to top-heaviness.

21 Claims, 2 Drawing Sheets

LOW-PROFILE DOCUMENT FEEDING MACHINE WITH HOPPER FLOOR FOR COLUMN FORMING DOCUMENTS

CROSS-REFERENCE TO RELATED APPLICATIONS

This application is related to U.S. application Ser. No. 11/206,728, filed Aug. 18, 2005, entitled "Low-Profile Document Feeding Machine With Hopper Extension."

BACKGROUND OF THE INVENTION

1. Field of the Invention

The invention relates to document handling equipment including document feeding machines. More specifically, the invention relates to small, counter-top, low-profile document feeding machines.

2. Background Art

There is a trend in the processing of checks and like financial instruments towards what is known as "distributed capture." With the passage of the "Check Processing for the 21st Century Act of 2004" (a/k/a "Check 21"), there is market pressure towards processing checks closer and closer to the point of capture—the teller window or the check-out line. To this end, manufacturers of check-processing machinery are offering a range of check-processing machines which are much smaller, lighter and cheaper than the traditional mass-processing systems which have dominated this market for 40 years.

For example, the MyVisionX product is a low-profile document feeding machine for decentralized document processing, and is available from Unisys Corporation, Blue Bell, Pa. The MyVisionX product is representative of a large number of machines, very similar in size, function, Among the functional requirements for such machines are: the very smallest possible footprint to minimize the use of counter space, the lowest possible profile (height), and one-handed loading and unloading.

To meet these ends, manufacturers typically optimize the designs of their machines around the size of the "standard" United States personal check, which is 6" long by 2.75" high. Problems often arise when users attempt to load much larger documents into such machines. Checks up to 9.5" long and 4.5" high are by no means unknown in the United States, and these very small machines have difficulty in handling documents this large.

The low profile of the machine typically means that taller items are unsupported at their upper edges when loaded into a feed hopper, and will fall over or fold horizontally because they are top-heavy. And the small footprint of these machines typically means that the area available in the feed hopper to support the bottom edges of loaded documents is less than half of the length of the longer type of document. As a result, the long documents overbalance and fall out of the hopper.

Traditional mass-processing systems have always addressed these issues by surrounding the documents with hopper walls almost as high as the tallest documents, by making feed hoppers with floor surfaces long enough to support the very longest documents, and by securing the documents with a hand-operated movable flag that is almost as high as the tallest documents. In this way, documents can be fully supported and cannot tip over or overbalance.

These approaches, however, are not directly applicable to this new class of smaller machines because these approaches violate the functional requirements for lowest profile, smallest possible footprint, and one-handed loading and unloading.

For the foregoing reasons, there is a need for a low-profile document feeding machine that addresses the problem of very long and/or tall documents presenting difficulties in feeding because they are top-heavy and will not stand vertically in the conventional feed hopper.

SUMMARY OF THE INVENTION

It is, therefore, an object of the invention to provide an improved low-profile document feeding machine that provides improved document feeding.

In one aspect, the invention involves a low-profile document feeding machine with a hopper extension for better supporting longer documents to prevent them from overbalancing and falling out of the hopper. In another aspect, the invention involves a low-profile document feeding machine with a hopper floor configured to column-form documents to provide increased stiffness in the vertical direction to prevent documents from falling or folding over due to top-heaviness.

In a preferred implementation, the document feeding machine has a hopper floor-wall construction that prevents top-heavy documents from tipping, falling or folding when placed in the feed hopper. At the same time, the preferred hopper floor-wall construction does not compromise the ease of loading, low profile and simplicity required of this class of machine. In the preferred approach, the hopper floor is extended to better support longer documents, and the hopper floor stabilizes the documents by utilizing a technique known as "column-forming" where documents above a certain length are urged into a column, thereby providing increased stiffness in the vertical direction. In more detail, column-forming a document involves forming a segment of a column at a portion of the document. This column segment is generally cylindrical in shape, and has a generally vertical axis. Column-forming a stack of longer documents results in increased stiffness in the vertical direction that stabilizes the documents.

According to one aspect of the invention, an extension is added to the hopper floor of the document feeding machine. The extension may be made a permanent part of the machine, or the extension may be made as, for example, a removable extension piece that the user may remove when very long and/or tall items are not being processed.

The inventive concept of extending the hopper floor, at the more detailed level, comprehends a number of additional features that could be present in an implementation of the invention. In one feature, the hopper extension extends the plane of the floor of the hopper to a length just sufficient to prevent very long documents from overbalancing. The inventors have found that an extension sufficient to extend the length of the hopper floor to about 5.5" is sufficient to render 9.5" long documents stable and prevent them from tipping backwards out of the hopper. It is appreciated that the appropriate length of the extension may vary depending on the application.

In another feature, the hopper extension may include features that act only on longer documents and tend to deform the documents so as to form a large-radius curve, about a more-or-less vertical axis, in the last portion of the document length. This radius changes the documents from being essentially planar to being in a columnar form, and greatly increases stiffness in the vertical direction. This increased vertical stiffness prevents documents from falling over or folding horizontally due to their top-heaviness, while avoiding interference with the normal planar separation and feeding of documents out of the hopper. The inventors have found that for a particular application it is appropriate for the column-forming features to act only on documents longer than about 7", and form the large-radius curve in the last 2-3" of document length.

It is appreciated, that in a preferred embodiment, the column-forming features are arranged to column-form only documents above a certain length. In this way, shorter documents can be loaded into the machine without any interaction at all with the column-forming features.

DETAILED DESCRIPTION OF THE PREFERRED EMBODIMENT

Figure 1:
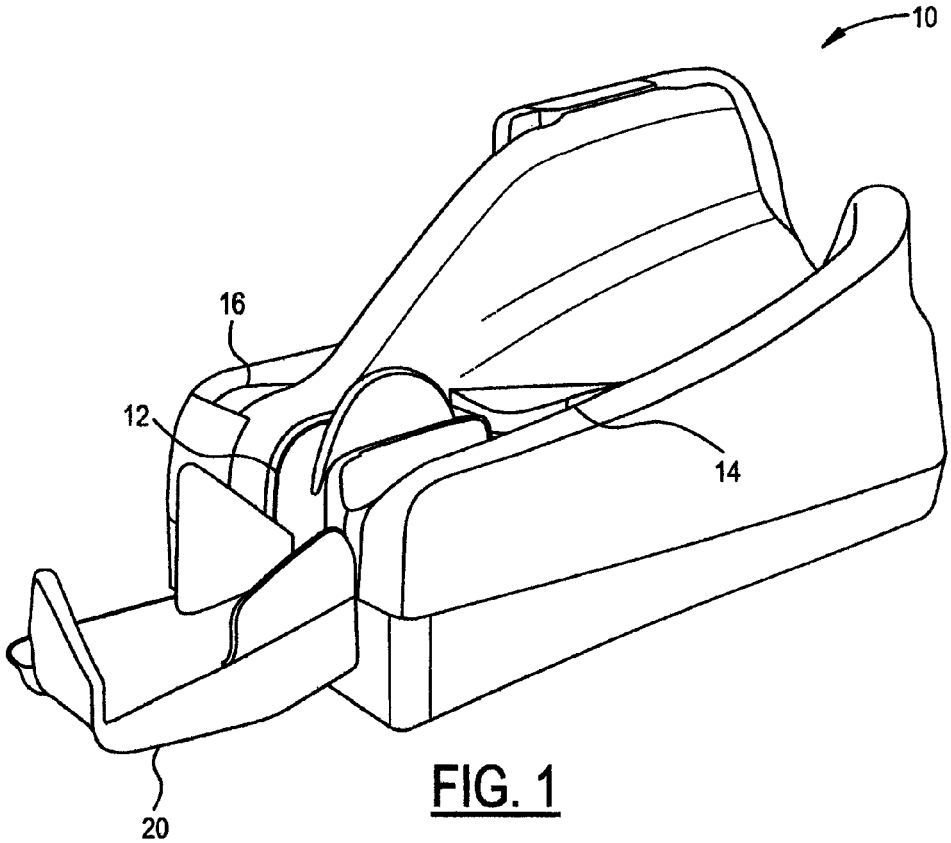
FIG. 1 illustrates a low-profile document feeding machine in a preferred embodiment of the invention, having a hopper extension for better supporting longer documents and having a hopper floor-wall construction configured to column-form documents for increased stiffness in the vertical direction.
Figure 2:
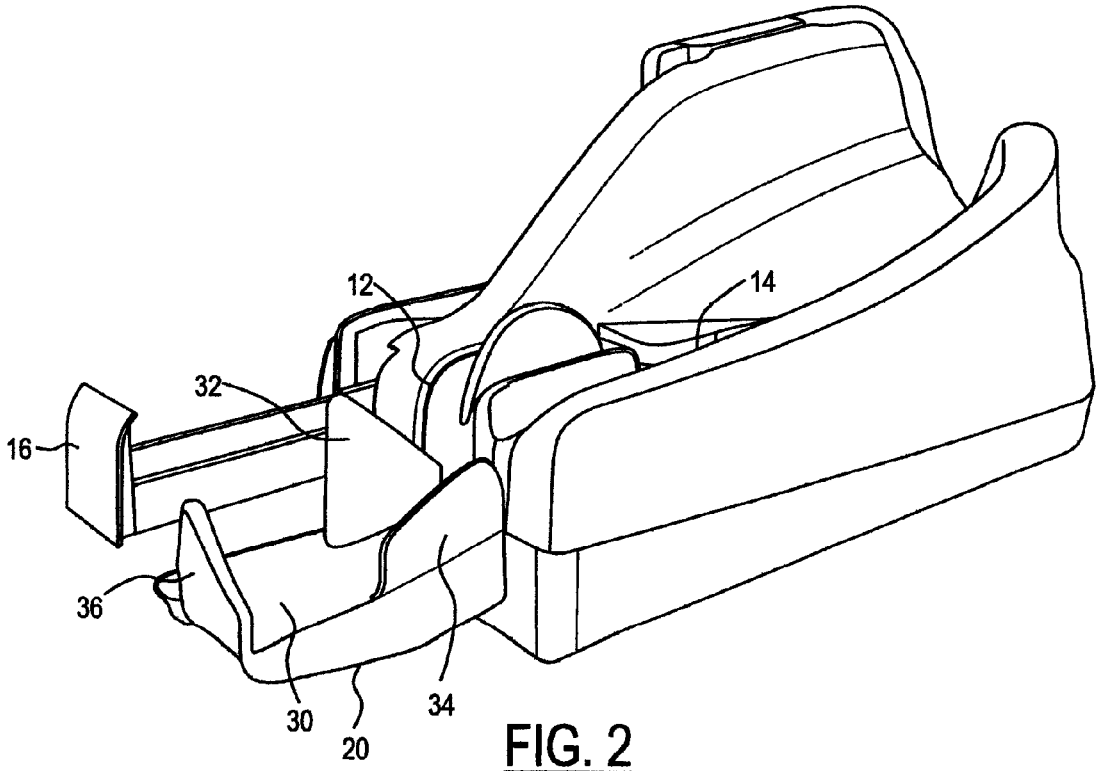
FIG. 2 illustrates the low-profile document feeding machine with the output pocket extended to accept longer documents.

With reference to FIGS. 1-4, the low-profile document feeding machine in the preferred embodiment of the invention is generally indicated at 10. Document feeding machine 10 is suitable for decentralized document processing. Document feeding machine 10 has a low profile (height), small footprint to minimize the use of counter space in counter-top applications, and allows one-handed loading and unloading of documents. Automatic feeder 12 feeds documents, one at a time, from a stack of documents placed in hopper extension 20. The documents are fed through document track 14 for processing. The track 14 is U-shaped and routes documents past processing devices to output pocket 16 which is adjustable to accommodate documents of different lengths.

As the documents traverse the track, the processing devices acting on the documents may include a magnetic ink character recognition (MICR) reader for capturing information from the document, an ink-jet endorser to provide printing of audit trail information and logos, and an image capture device for capturing multiple images of the front and rear of the document. Typically, the feeding machine 10 passes gathered information from the processing device to a connected computer which processes the information as required for the particular application.

Figure 4:
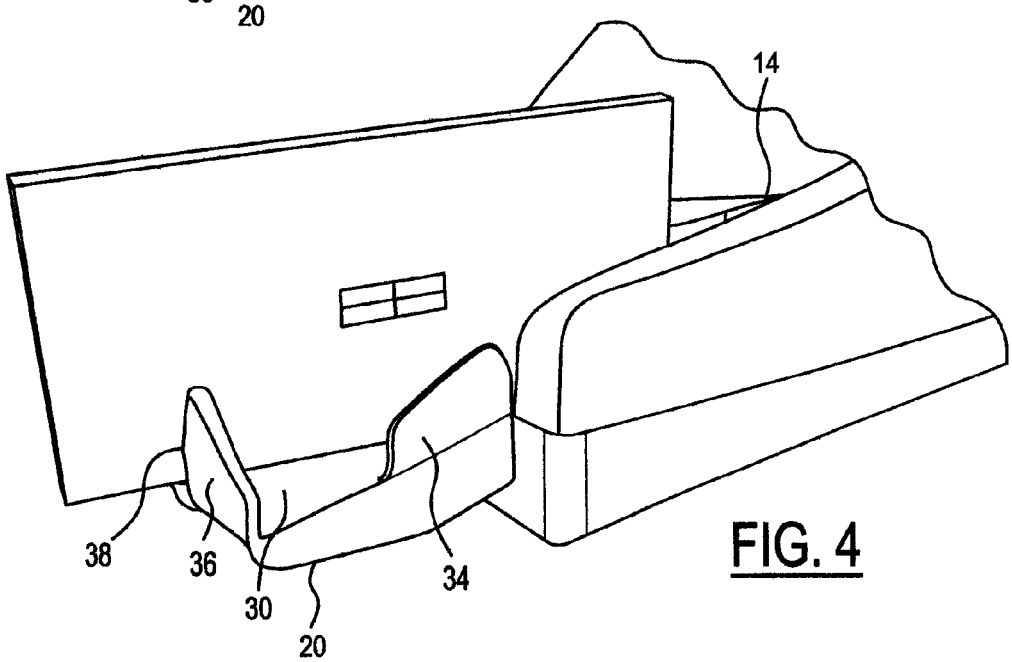
FIG. 4 illustrates the low-profile document feeding machine with the hopper loaded with longer documents that are deformed by the column-forming features of the hopper extension so as to form a large-radius curve in the last portion of the document length.

Hopper extension 20 supports longer documents to prevent them from overbalancing and falling out of the hopper. This overcomes a problem with existing feeding machines where the area available in the feed hopper to support the bottom edges of loaded documents is less than half of the length of the longer type of document, and, as a result, the long documents overbalance and fall out of the hopper. As best shown in FIG. 4, a stack 24 of longer documents is supported by hopper extension 20.

In another feature of the preferred embodiment, low-profile document feeding machine 10 is arranged to column-form documents. Features on hopper floor extension 20 are configured to column-form the documents and to provide increased stiffness in the vertical direction. This prevents documents from falling or folding over due to top-heaviness. This overcomes a problem with existing feeding machines where taller items are unsupported at their upper edges when loaded into a feed hopper, and will fall over or fold horizontally because they are top-heavy.

Figure 5:
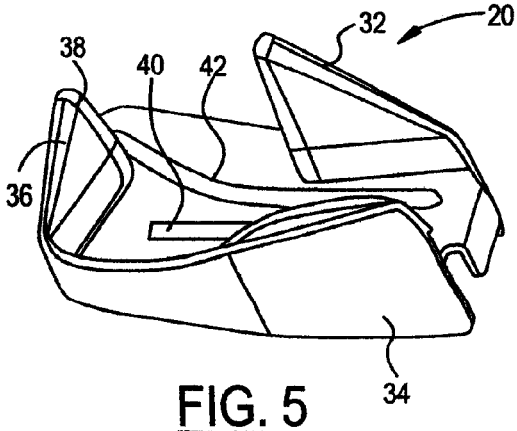
FIG. 5 is a perspective view of the preferred embodiment of the hopper extension.
Figure 6:
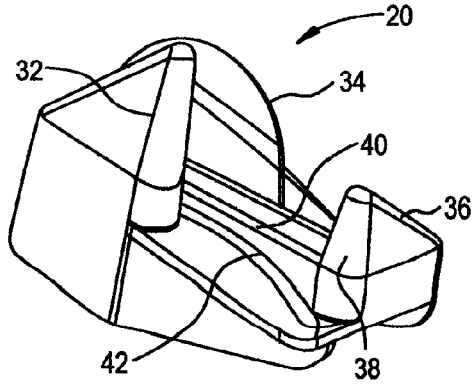
FIG. 6 is another perspective view of the preferred embodiment of the hopper extension.

With reference to FIGS. 1-6, and as best shown in FIGS. 5-6, outer hopper sidewalls 32 and 34 retain the documents within hopper extension 20. Column-forming element 36 acts only on longer documents and tends to deform the documents so as to form a large-radius curve, about a more-or-less vertical axis, in the last portion of the document length. Face 38 of element 36 abuts the document stack during column-forming. This is best shown in FIG. 4 where longer documents 24 are column-formed and engage face 38 of element 36.

Figure 3:
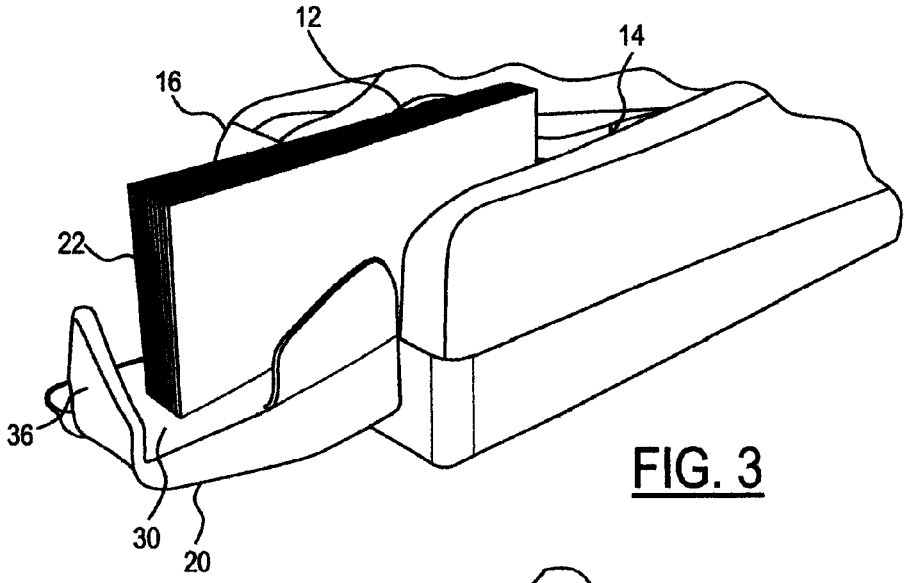
FIG. 3 illustrates the low-profile document feeding machine with the hopper loaded with shorter documents such that the shorter documents do not interact at all with the column-forming features of the hopper extension.

As best shown in FIG. 3, shorter documents 22 may be placed in hopper extension 20 and because these documents are below a certain length, they do not interact at all with column-forming element 36. In an additional aspect of the preferred embodiment, tracks 40 and 42 (FIGS. 5 and 6) help guide documents when they are being placed in hopper extension 20.

It is appreciated that hopper extension 20 extends the plane of the floor of the hopper to a length just sufficient to prevent very long documents from overbalancing. The inventors have found that an extension sufficient to extend the length of the hopper floor to about 5.5" is sufficient to render 9.5" long documents stable and prevent them from tipping backwards out of the hopper. The inventors have also found that for a particular application it is appropriate for the column-forming features to act only on documents longer than about 7" and form the large-radius curve in the last 2-3" of document length.

In operation, when a stack of longer documents is loaded into hopper extension 20, a curvature is imposed upon the documents, forming a columnar configuration which increases the vertical stiffness to the point that the stack of documents is vertically stable. The arrangement of elements 32 and 36 is such that the curvature imposed on a full stack is not so excessive so as to prevent proper feeding of the documents, while the curvature imposed when only the last few documents remain in the stack is sufficient to keep the documents from falling or folding over. It should be appreciated by one of ordinary skill in the art that the optimal relationship among the feeder 12, element 32, element 34, and element 36 may vary depending on the application.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low-profile document feeding apparatus for use on a counter-top, the apparatus comprising:

a low-profile document feeding machine sized to handle documents which are 6inches long and 2.75 inches high, the low-profile document feeding machine including a feeder, a hopper having a hopper floor, at least one processing device, and an output pocket, the hopper holding a document stack wherein the length of the documents extends horizontally along the hopper floor with each document resting on its edge, the feeder feeding documents one at a time from the document stack in the hopper for processing by the at least one processing device and reception by the output pocket, the documents being fed in the horizontal direction from the hopper such that a feeding document slides on its edge;

wherein the hopper includes a floor-wall construction for holding the document stack with the documents standing vertically, the floor-wall construction being configured to column-form documents in the document stack to provide increased stiffness in the vertical direction and prevent documents from falling/folding over due to top-heaviness.

2. The apparatus of claim 1 wherein the hopper floor includes a hopper floor extension, the hopper floor extension extending sufficiently beyond a footprint of the low-profile document feeding machine so as to better support longer documents.

3. The apparatus of claim 2 wherein the hopper floor extension is integral to the document feeding machine.

4. The apparatus of claim 2 wherein the hopper floor extension is removable.

5. The apparatus of claim 2 wherein the hopper floor extension extends beyond the footprint of the low-profile document feeding machine such that a total length of the hopper floor is at least about 5.5 inches thereby facilitating the stable processing of longer documents which are 9.5 inches long without the larger documents tipping backwards out of the hopper.

6. The apparatus of claim 5 wherein the total length of the hopper floor is about 5.5 inches.

7. The apparatus of claim 1 wherein the hopper floor floor-wall construction includes a plurality of elements arranged to act on the documents to deform the documents so as to form a large-radius curve about a generally vertical axis.

8. The apparatus of claim 7 wherein the large-radius curve occurs in a last portion of the document length, furthest from the feeder.

9. The apparatus of claim 1 wherein the hopper floor floor-wall construction is arranged to column-form only documents above a predetermined length while shorter documents can be loaded into the low-profile document feeding machine without column-forming.

10. The apparatus of claim 9 wherein documents longer than about 7 inches are column-formed.

11. The apparatus of claim 10 wherein the column-forming deforms the documents so as to form a large-radius curve about a generally vertical axis.

12. The apparatus of claim 11 wherein the large-radius curve occurs in a last portion of the document length of about 2-3 inches, furthest from the feeder.

13. A low-profile document feeding apparatus for use on a counter-top, the apparatus comprising:

a low-profile document feeding machine including a feeder, a hopper having a hopper floor, at least one processing device, and an output pocket, the hopper holding a document stack wherein the length of the documents extends horizontally along the hopper floor with each document resting on its edge, the feeder feeding documents one at a time from the document stack in the hopper for processing by the at least one processing device and reception by the output pocket, the documents being fed in the horizontal direction from the hopper such that a feeding document slides on its edge;

wherein the hopper includes a floor-wall construction for holding the document stack with the documents standing vertically, the floor-wall construction being configured to column-form documents in the document stack to provide increased stiffness in the vertical direction and prevent documents from falling/folding over due to top-heaviness.

14. The apparatus of claim 13 wherein the hopper floor includes a hopper floor extension, the hopper floor extension extending sufficiently beyond a footprint of the low-profile document feeding machine so as to better support longer documents.

15. The apparatus of claim 14 wherein the hopper floor extension extends beyond the footprint of the low-profile document feeding machine such that a total length of the hopper floor is at least about 5.5 inches.

16. The apparatus of claim 13 wherein the hopper floor floor-wall construction includes a plurality of elements arranged to act on the documents to deform the documents so as to form a large-radius curve about a generally vertical axis.

17. The apparatus of claim 16 wherein the large-radius curve occurs in a last portion of the document length, furthest from the feeder.

18. The apparatus of claim 13 wherein the hopper floor floor-wall construction is arranged to column-form only documents above a predetermined length while shorter documents can be loaded into the low-profile document feeding machine without column-forming.

19. The apparatus of claim 18 wherein documents longer than about 7 inches are column-formed.

20. The apparatus of claim 19 wherein the column-forming deforms the documents so as to form a large-radius curve about a generally vertical axis.

21. The apparatus of claim 20 wherein the large-radius curve occurs in a last portion of the document length of about 2-3 inches, furthest from the feeder.

* * * * *

UNITED STATES PATENT AND TRADEMARK OFFICE

CERTIFICATE OF CORRECTION

PATENT NO. : 7,887,047 B2
APPLICATION NO. : 11/206729
DATED : February 15, 2011
INVENTOR(S) : Johan P. Bakker et al.

It is certified that error appears in the above-identified patent and that said Letters Patent is hereby corrected as shown below:

Please correct Claim 1 as follows:

Column 4, line 65, delete “6inches” and insert -- 6 inches --.

Signed and Sealed this
Second Day of August, 2011

David J. Kappos

David J. Kappos
*Director of the United States Patent and Trademark Office*